US009413050B2

(12) United States Patent
Wang

(10) Patent No.: US 9,413,050 B2
(45) Date of Patent: Aug. 9, 2016

(54) DISTRIBUTEDLY MODULATED CAPACITORS FOR NON-RECIPROCAL COMPONENTS

(71) Applicant: THE REGENTS OF THE UNIVERSITY OF CALIFORNIA, Oakland, CA (US)

(72) Inventor: Yuanxun Ethan Wang, Manhattan Beach, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 119 days.

(21) Appl. No.: 14/513,888

(22) Filed: Oct. 14, 2014

(65) Prior Publication Data

US 2015/0102869 A1 Apr. 16, 2015

Related U.S. Application Data

(60) Provisional application No. 61/890,410, filed on Oct. 14, 2013.

(51) Int. Cl.

| | |
|---|---|
| ***H01P 1/32*** | (2006.01) |
| ***H01P 1/36*** | (2006.01) |
| ***H01P 1/387*** | (2006.01) |
| *H01P 1/15* | (2006.01) |

(52) U.S. Cl.
CPC *H01P 1/36* (2013.01); *H01P 1/387* (2013.01); *H01P 1/15* (2013.01)

(58) Field of Classification Search
CPC ..... H01P 1/32; H01P 1/36
USPC ..... 333/1.1, 24.2, 24.1
See application file for complete search history.

(56) References Cited

U.S. PATENT DOCUMENTS

| | | | | |
|---|---|---|---|---|
| 2009/0002090 | A1* | 1/2009 | Pietig | H01P 1/38 333/24.2 |
| 2010/0079217 | A1* | 4/2010 | Morton | H01P 1/2005 333/24.2 |

* cited by examiner

*Primary Examiner* — Stephen E Jones
(74) *Attorney, Agent, or Firm* — O'Banion & Ritchey LLP; John P. O'Banion

(57) ABSTRACT

An apparatus and method for realizing non-reciprocal components, such as isolators and circulators, for operation over a broad bandwidth without requiring magnetic components/material which would prevent integrated circuit manufacture utilizing standard processes is presented. In one example, a circulator is described including varactor diodes coupled at each unit cell in a balanced manner between halves of a differential signal path and halves of a differential carrier path. In another example, variable capacitors are coupled at each unit cell between a signal path and ground, and having a tuning input of the variable capacitor receiving a signal from a carrier path.

23 Claims, 5 Drawing Sheets

DISTRIBUTEDLY MODULATED CAPACITORS FOR NON-RECIPROCAL COMPONENTS

CROSS-REFERENCE TO RELATED APPLICATIONS

This application claims priority to, and the benefit of, U.S. provisional patent application Ser. No. 61/890,410 filed on Oct. 14, 2013, incorporated herein by reference in its entirety.

STATEMENT REGARDING FEDERALLY SPONSORED RESEARCH OR DEVELOPMENT

Not Applicable

INCORPORATION-BY-REFERENCE OF COMPUTER PROGRAM APPENDIX

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND

1. Technological Field

This technical disclosure pertains generally to making non-reciprocal components utilizing distributed modulated capacitors (DMC), and more particularly to DMC circulators for allowing microwave signals to travel in opposite directions along the same path and be readily separated.

2. Background Discussion

It is well known that based on the reciprocity theorem, non-reciprocity cannot be realized in a lossless form if the component is made of only linear, passive, reciprocal material. Non-reciprocal microwave components, such as isolators and circulators, require the use of non-reciprocal material, for example ferrite magnetic material. These components, however, are often bulky, lossy and narrow band, particularly when they are operated at the lower end of the microwave frequency spectrum.

Separating a transmitting and receiving channel connected to a single antenna is currently realized with circulators which are often fabricated using non-reciprocal magnetic material, such as ferrite. They are not compatible with the standard integrated circuit process and can provide good performance over only a relatively narrow band. Circulators based on optical links can offer broadband performance, however, they are physically bulky and cannot be integrated on-chip either. Active circulators based on transistor amplifiers have also been developed, but these devices add noise to the receiver, while the use of these active devices limits the maximum operating power of the transmitter.

Accordingly, a need exists for apparatus and methods for realizing non-reciprocal components without the limitation of previous techniques.

BRIEF SUMMARY

A new technique is described for realizing non-reciprocal components, such as circulators, that can operate over a broad bandwidth. In these DMC circulators, a signal traveling in the same direction as that of the carrier wave will be modulated on the carrier while the signal that travels in the opposite direction will not. Accordingly, signals traveling in opposite directions on the same path (e.g., antenna or transmission line) can be readily separated.

DMC circulators of this disclosure can be manufactured with a standard integrated circuit process. Devices utilizing this technique provide a pathway toward creating integrated electronics which are capable of simultaneous transmitting and receiving through the same antenna, at the same time, and over the same frequency.

Circulators of the present disclosure can be realized with standard single or multi-layer printed circuits without need for magnetic components or material. It can thus be integrated on the same chip with other parts of electronics and offer great advantages in dimension and production cost. It can be designed to operate over a broad bandwidth as well, with minimal noise contribution to the receiver, and without significantly constraining transmit power.

In at least one embodiment, it is contemplated to meld these DMC circulators with state of the art integrated circuit technology, such as monolithic microwave integrated circuit (MMIC) or radio frequency integrated circuit (RFIC), with its applications to high-performance microwave and millimeter wave radio systems.

Commercial applications include, but are not limited to, compact radar systems, miniaturized radios such as cellphones and high performance RFID readers.

Further aspects of the presented technology will be brought out in the following portions of the specification, wherein the detailed description is for the purpose of fully disclosing preferred embodiments of the technology without placing limitations thereon.

BRIEF DESCRIPTION OF THE SEVERAL VIEWS OF THE DRAWING(S)

The disclosed technology will be more fully understood by reference to the following drawings which are for illustrative purposes only:

DETAILED DESCRIPTION

The present disclosure describes non-reciprocal components formed along a combination transmit-receive path which are loaded with time-varying capacitors. The time-variance of the transmission line property adds a new dimension to non-reciprocal component design for microwave applications and can potentially provide non-magnetic, broadband and lossless realization of isolators or circulators. One of the more significant advantages of this form of design is that the device can be made compatible with modern integrated circuit technology, which may lead to monolithic integration of the complete transceiver front-end that provides isolation between the transmitting and receiving path without resorting to a frequency or time diplexer. It will be recognized that the need for magnetic materials are not readily implemented on integrated circuits, due to their bulk, and the general lack of integrated circuit process technology for magnetic materials.

Figure 1:
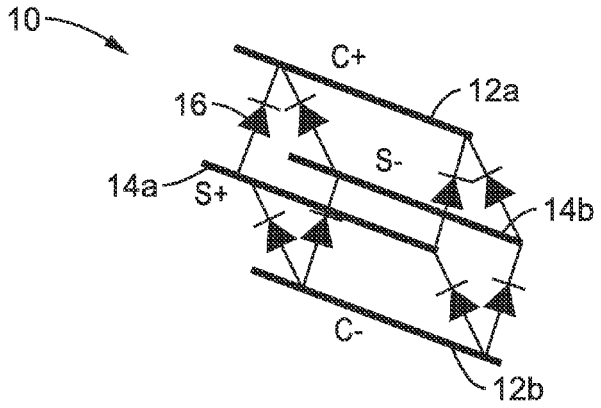
FIG. 1 is a schematic of a non-reciprocal component, in particular a distributed modulated capacitor (DMC) circulator according to an embodiment of the disclosed technology.
Figure 2:
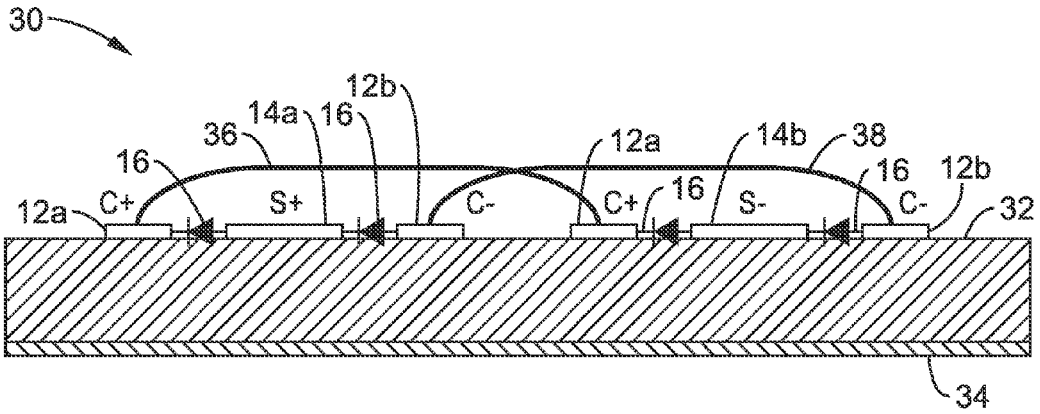
FIG. 2 is a cross-section view of a distributed modulated capacitor (DMC) circulator, shown implemented on a flat substrate, according to an embodiment of the disclosed technology.

FIG. 1 and FIG. 2 illustrate example embodiments 10, 30, of one realization of the use of distributed modulated capacitors (DMC) through a double balanced configuration of varactor diodes on which the carrier and the signal waves propagate on different, electrically isolated transmission lines (or paths), while the shunt capacitance of both transmission lines (or paths) is predominantly controlled by the carrier wave. It should be appreciated that a varactor diode, (also often referred to as a "varicap diode", "variable capacitance diode", "variable reactance diode" or "tuning diode"), is a form of diode presenting a capacitance which varies as a function of the voltage applied across its terminals.

In FIG. 1 a schematic illustrates an embodiment 10 of such a structure with carrier lines C+ 12*a*, C− 12*b*, signal lines S+ 14*a*, and S− 14*b*, and varactor diodes 16 interconnecting between each of the signal lines for each unit cell along these lines. The cathode sides of the varactor diodes are oriented toward C+ 12*a* and S+ 14*a* respectively. The double balanced configuration as depicted allows the cancellation of the capacitance modulation caused by the signal voltage and the construction of the capacitance modulation caused by the carrier voltage. This is to achieve the transmission line capacitance modulation solely by the carrier while maintaining the linearity of the signal in transmitting and receiving.

In FIG. 2 is seen illustrated an embodiment 30 upon a substrate 32 with ground plane 34. In at least one preferred embodiment, this substrate comprises a microstrip line realization (shown here in cross-section). One can see that C+ 12*a*, and C− 12*b* lines are duplicated on each side of lines S+ 14*a*, and S− 14*b* which are interconnected between each unit cell with varactor diodes 16, as was seen in FIG. 1. Bonding wires 36, 38, are seen interconnecting the two C+ lines 12*a*, and the two C− lines 12*b*. Alternatively, it will be appreciated that the S lines could be duplicated and placed on each side of the C lines. The theory behind DMC operation, such as exemplified but not limited to the embodiments shown in FIG. 1 and FIG. 2 are discussed below.

Transmission Line Solutions with Time-Varying Capacitances.

Transmission lines whose reactance is time-varying are known to have interesting properties. One of the classical applications is the traveling wave parametric amplifiers which were studied in the late 1950's. The basic analysis for transmission lines with time-varying capacitance is derived as follows. Considering transmission line equations with time-varying capacitance:

$$\begin{cases} \dfrac{\partial V(z,t)}{\partial z} = -L\dfrac{\partial I(z,t)}{\partial t} \\ \dfrac{\partial I(z,t)}{\partial t} = -\dfrac{\partial [C(z,t)V(z,t)]}{\partial t} \end{cases} \tag{1}$$

V(z,t) and I(z,t) represent, respectively, the voltage and current along the transmission line as a function of distance and time. L is the inductance per unit length of the transmission line, while C(z,t) is the capacitance per unit length of the transmission line which is also a function of distance and time due to the modulation. Rewriting the equations for voltage and current independently yields:

$$\frac{\partial^2 V(z,t)}{\partial z^2} - L\frac{\partial^2 [C(z,t)V(z,t)]}{\partial t^2} = 0 \tag{2}$$

The above equation being applicable when the capacitance is modulated by a single-tone carrier which is a wave traveling in the same direction as that of the original signal. The capacitance thus has the following form:

$$C(z,t) = C_0 + C_m\cos(\omega_m t - \beta_m z) \text{ where } \frac{\omega_m}{\beta_m} = \frac{1}{\sqrt{LC_0}}$$

Equation (2) now becomes:

$$\frac{\partial^2 V(z,t)}{\partial z^2} - LC_0\frac{\partial^2 V(z,t)}{\partial t^2} - LC_m\frac{\partial^2 [\cos(\omega_m t - \beta_m Z)V(z,t)]}{\partial t^2} = 0 \tag{3}$$

It is evident from Eq. (3) that a signal wave launched into this transmission line will be mixed up and down with the capacitance modulation frequency, which will generate many harmonic and intermodulation terms. One can limit the discussions to the three major terms only at the frequencies $\omega_s$, $\omega_{m-s}$, $\omega_{m+s}$, where subscript "s" represents the original signal frequency and "m" represents the modulation frequency. It will be noted that the modulation frequency is normally chosen to be much greater than the signal frequency. It is expected that the magnitudes of these terms vary in distance due to energy coupling and conversion while the waves propagate along the transmission line. It will be noted that the selection of carrier frequency (modulation frequency) is normally higher than the signal frequency to: (a) avoid the overlap of frequencies between the unconverted signal band and the original signal band, and (b) to achieve the higher conversion gain (lower loss). There is no absolute number for this ratio as it depends on the system bandwidth and gain requirement. In the prototype, the factor was 10 times that of the lowest signal frequency and approximately 2.5 times that of the highest signal frequency. Assuming the transmission line is non-dispersive over a broad bandwidth, one can easily prove that solutions exist for equation (3), as given by:

$$V(z,t) = V_s(z)\cos(\omega_s t - \beta_s z + \varphi_s) - V_{m-s}(z)\sin(\omega_{m-s} t - \beta_{m-s} z + \varphi_s) - V_{m+s}(z)\sin(\omega_{m+s} t - \beta_{m+s} z + \varphi_s) \text{ where:}$$

$$\begin{cases} V_s(z) = V_0\cos\left(\frac{1}{2\sqrt{2}}\xi_1\beta_s z\right) \\ V_{m-s}(z) = \frac{V_0}{\sqrt{2}}\frac{\beta_{m-s}}{\beta_s}\sin\left(\frac{1}{2\sqrt{2}}\xi_1\beta_s z\right) \text{ and } \xi_1 = \frac{C_m}{C_0}. \\ V_{m+s}(z) = \frac{V_0}{\sqrt{2}}\frac{\beta_{m+s}}{\beta_s}\sin\left(\frac{1}{2\sqrt{2}}\xi_1\beta_s z\right) \end{cases} \quad (4)$$

It is evident from Eq. (4) that the transmission line with time-varying capacitance allows for coupling of the propagating modes at different frequencies in a lossless fashion when these modes are propagating in the same direction as the modulation signal. The total amount of energy, counting all the three tones, increases along the TVTL as the energy of the modulation signal is injected into the system through the capacitance modulation.

When the transmission line, or path, is sufficiently long, the "m−s" and "m+s" terms will eventually reach their maximum where they are amplified with the factors of $\beta_{m-s}/\beta$ and $\beta_{m+s}/\beta$ respectively. It should be appreciated that this gain of the TVTL is similar to that of the parametric amplifier. In theory, it does not introduce any noise into the system if the ohmic resistance of the varactors is ignored. In reality, the loss of the diodes will eventually accumulate to a certain degree so that a long TVTL is no longer practical even with high-Q varactor diodes. On the other hand, a signal wave traveling in the opposite direction of the modulation carrier does not interact with the capacitance modulation and the coupling among different modes will not arise. Based on these properties, lossless and non-reciprocal components with a small amount of gain can be potentially realized in this manner.

Circulator with Distributedly Modulated Capacitors (DMC).

Figure 3:
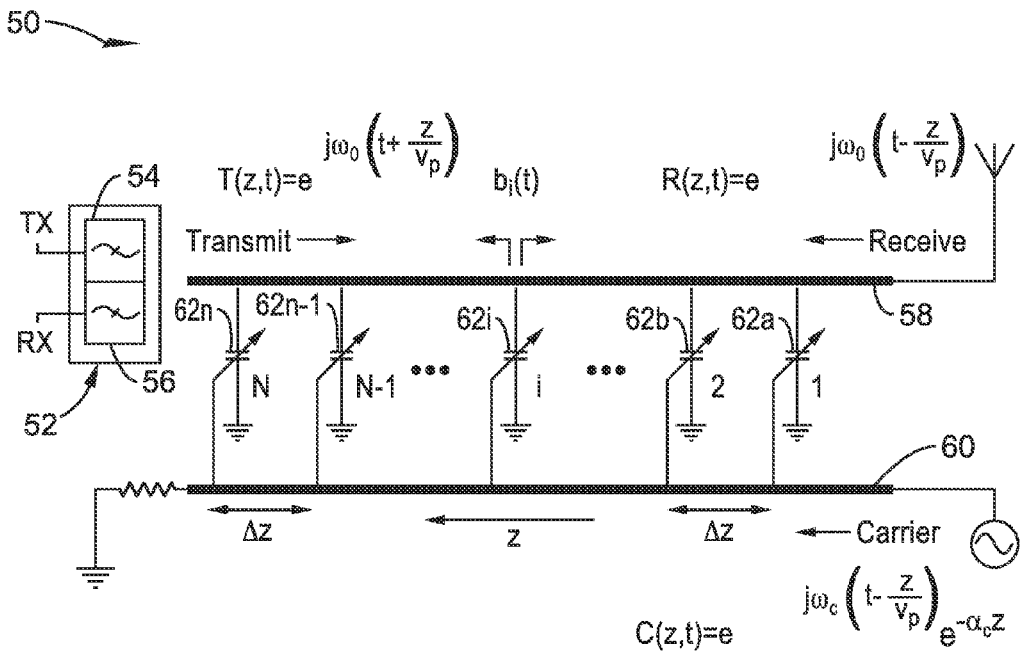
FIG. 3 is a schematic of a distributed modulated capacitor (DMC) circulator, shown comprising a bank of variable capacitors, according to an embodiment of the disclosed technology.

FIG. 3 illustrates an example embodiment 50 of a circulator utilizing a bank of capacitors. A device 52 is shown with transmitter (TX) 54 and receiver (RX) 56 capability. A combination transmit-receive line (TRL) 58 is shown for transmitting and receiving in opposite directions, with a line 60 for a carrier traveling in a single direction. A plurality of variable capacitances 62*a*, 62*b*, through to 62*i*, and on through to 62*n*−1 and 62*n* are coupled between the transmission line 58 and ground. The capacitance of each capacitor is shown being varied in response to the carrier signal on line 60. Transmission voltage is propagating in the −z direction, characterized by $T(z,t)=e^{j\omega_0(t+z/v_p)}$. The receiver voltage is propagating in +z direction, and is characterized by $R(z,t)=e^{j\omega_0(t-z/v_p)}$.

It will be recognized that ferrite circulators typically offer only about 13 dB of isolation over bandwidths smaller than one octave. The circulator of the presented technology uses a bank of capacitors whose capacitance is modulated with a carrier wave that travels in one direction. An intuitive analysis is provided as follows to show that a signal traveling in the same direction as that of the carrier wave will be modulated on the carrier while the signal that travels in the opposite direction will not. This separates signals traveling in opposite directions on the same path into different frequencies so that they can be separated with a frequency diplexer at the end.

In FIG. 3, it will be noted that a bank of N capacitors is distributed with equal delay Δz between them. The capacitance of each capacitor in the bank is modulated by the carrier wave traveling in the positive Z direction in the lower TRL. The carrier wave is represented by the function:

$$C(z,t) = e^{j\omega_c\left(t-\frac{z}{v_p}\right)}e^{-\alpha z} \quad (5)$$

which includes both phase delay along the line and a certain attenuation factor caused by the energy conversion and the propagation loss. The carrier wave mixes with the waves propagating on the upper TRL, generates modulated signal $b_i^{RX}(t)$ at the ith capacitor propagating toward both ends of the upper TRL. When the received signal is incident from the right hand side as seen in the figure, then one of the sidebands in the modulated signal generated at the ith unit is:

$$\begin{aligned} b_i^{RX}(t) &= R_i(t)c_i(t) \\ &= e^{j\omega_0(t-i\Delta z/v_p)}e^{j\omega_c(t-i\Delta z/v_p)} \\ &= e^{j(\omega_0+\omega_c)(t-i\Delta z/v_p)}e^{i\alpha_c\Delta z}. \end{aligned} \quad (6)$$

The mixing gain is assumed to be unity for the above equation for simplicity as the conversion loss/gain is irrelevant to the directional isolation performance. The total modulated signal arriving at both ends is given respectively by:

$$\begin{aligned} b_{left}^{RX} &= \sum_{i=1}^{N} b_i^{RX}[t-(N-i)\cdot\Delta z/v_p] \\ &= \sum_{i=1}^{N} e^{j(\omega_0+\omega_c)(t-N\Delta z/v_p)}e^{-i\alpha_c\Delta z} \\ &= e^{j(\omega_0+\omega_c)(t-N\Delta z/v_p)}g\sum_{i=1}^{N} e^{-i\alpha_c\Delta z} \end{aligned} \quad (7)$$

$$\begin{aligned} b_{right}^{RX} &= \sum_{i=1}^{N} b_i^{RX}[t-i\cdot\Delta z/v_p] \\ &= \sum_{i=1}^{N} e^{j(\omega_0+\omega_c)(t-N\Delta z/v_p)} \\ &= e^{j(\omega_0+\omega_c)t}\sum_{i=1}^{N} e^{-j2i\cdot(\omega_0+\omega_c)/v_p\Delta z}e^{-i\cdot\alpha_c\Delta z} \to 0 \end{aligned} \quad (8)$$

Eq. (7) means the received signal arrives at the left end in its maximum amplitude while Eq. (8) shows good matching (e.g., a high level of matching, such as a return loss of beyond 10 dB) for the modulated received signal.

When the transmitted signal is injected from the left hand side, the associated modulated signal at the i-th unit is:

$$\begin{aligned} b_i^{TX}(t) &= T_i(t)c_i(t) \\ &= e^{j\omega_0[t-(N-i)\cdot\Delta z/v_p]}e^{j\omega_c(t-i\cdot\Delta z/v_p)}e^{-i\alpha\Delta z} \\ &= e^{j[(\omega_0+\omega_c)t-\omega_0(N-i)\cdot\Delta z/v_p-\omega_c i\Delta z/v_p]}e^{-i\cdot\alpha\Delta z}. \end{aligned} \quad (9)$$

The total modulated signal arriving at both ends in this case is, $$b_{left}^{TX} = \sum_{i=1}^{N} b_i^{TX}[t-(N-i)\cdot\Delta z/v_p] = \sum_{i=1}^{N} e^{j[(\omega_0+\omega_c)t-\omega_0\cdot 2(N-i)\cdot\Delta z/v_p-\omega_c N\cdot\Delta z/v_p]} e^{-i\alpha_c\Delta z} = e^{j[(\omega_0+\omega_c)t-\omega_c N\cdot\Delta z/v_p)} \sum_{i=1}^{N} e^{-j2(N-i)\omega_0\Delta z/v_p} e^{-i\alpha_c\Delta z} \to 0 \quad (10)$$

$$b_{right}^{TX} = \sum_{i=1}^{N} b_i^{TX}[t-i\cdot\Delta z/v_p] = \sum_{i=1}^{N} e^{j[(\omega_0+\omega_c)t-\omega_0\cdot N\cdot\Delta z/v_p-\omega_c 2i\cdot\Delta z/v_p]} e^{-i\alpha_c\Delta z} = e^{j[(\omega_0+\omega_c)t-\omega_0 N\cdot\Delta z/v_p]} \sum_{i=1}^{N} e^{-j2i\omega_c\Delta z/v_p} e^{-i\alpha_c\Delta z} \to 0 \quad (11)$$

Eqs. (10) and (11) show that the modulation of the transmitted signal on top of the carrier is suppressed in both ends of the transmission line, which indicates that the transmitting signal will pass directly to the antenna with minimum interaction of the DMC. The isolation at the front-end is thus given by:

$$b_{left}^{TX}/b_{left}^{RX} = \frac{1-e^{-N\alpha\Delta z}}{1-e^{-\alpha\Delta z}} \frac{1-e^{-N(\alpha_c+j2\beta_0)\Delta z}}{1-e^{-(\alpha_c+j2\beta_0)\Delta z}}. \quad (12)$$

When the loss for the carrier wave is negligible, (12) becomes, $$b_{left}^{TX}/b_{left}^{RX} = \frac{\sin(N\beta_0\Delta z)}{N\sin(\beta_0\Delta z)}. \quad (13)$$

It is evident from Eq. (13) that the isolation provided by DMC emulates that of sidelobe suppressions in phased arrays. Therefore, the isolation versus frequency performance can be shaped like the radiation of the phased array. Increased levels of isolation can be achieved with a non-uniform distribution of capacitor modulation coefficients.

In addition, for the DMC circulator, transmitting insertion loss (IL) should be zero because no coupling occurs. Receiver insertion loss is given by the parametric conversion gain derived as based on effective medium theory:

$$\frac{V_{c-s}(z)}{V_0} = \frac{1}{\sqrt{2}} \frac{f_c - f_s}{f_s} \sin\left(\frac{1}{2\sqrt{2}}\xi\beta_0 N\Delta z\right),$$

wherein $\xi$ is the capacitance variation ratio in each unit cell. Value $V_{c-s}(z)$ represents the voltage of the upconverted received signal, $V_0$ is the voltage of the original received signal, $f_c$ is the carrier frequency, and $f_s$ is the signal frequency.

Figure 4:
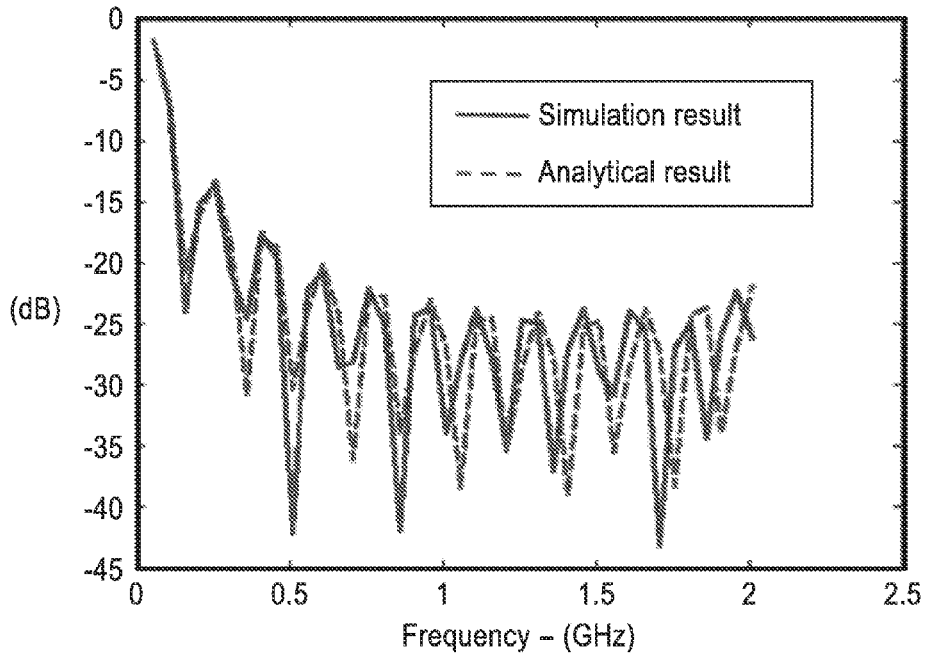
FIG. 4 is a plot comparing simulated and analytical leakage results for the DMC of FIG. 3, utilized according to an embodiment of the disclosed technology.

FIG. 4 depicts a leakage comparison between simulated and analytical DMC results according to the present disclosure, on a DMC made of 16 capacitors on a transmission line with a total length of 2-wavelengths at 0.7 GHz. By way of example the simulation was an Agilent ADS simulation which provides non-linear circuit simulations based on harmonic balance analysis. The simulation is based on non-linear capacitors instead of modulated capacitors for its simplicity while these two cases are equivalent when the signal power is much lower than the carrier power. The prediction of the leakage agrees well with that of the theory except at higher frequencies. This is because the modification of the phase velocity due to the periodical capacitance loading has not been considered when Eq. (13) is applied.

Figure 5:
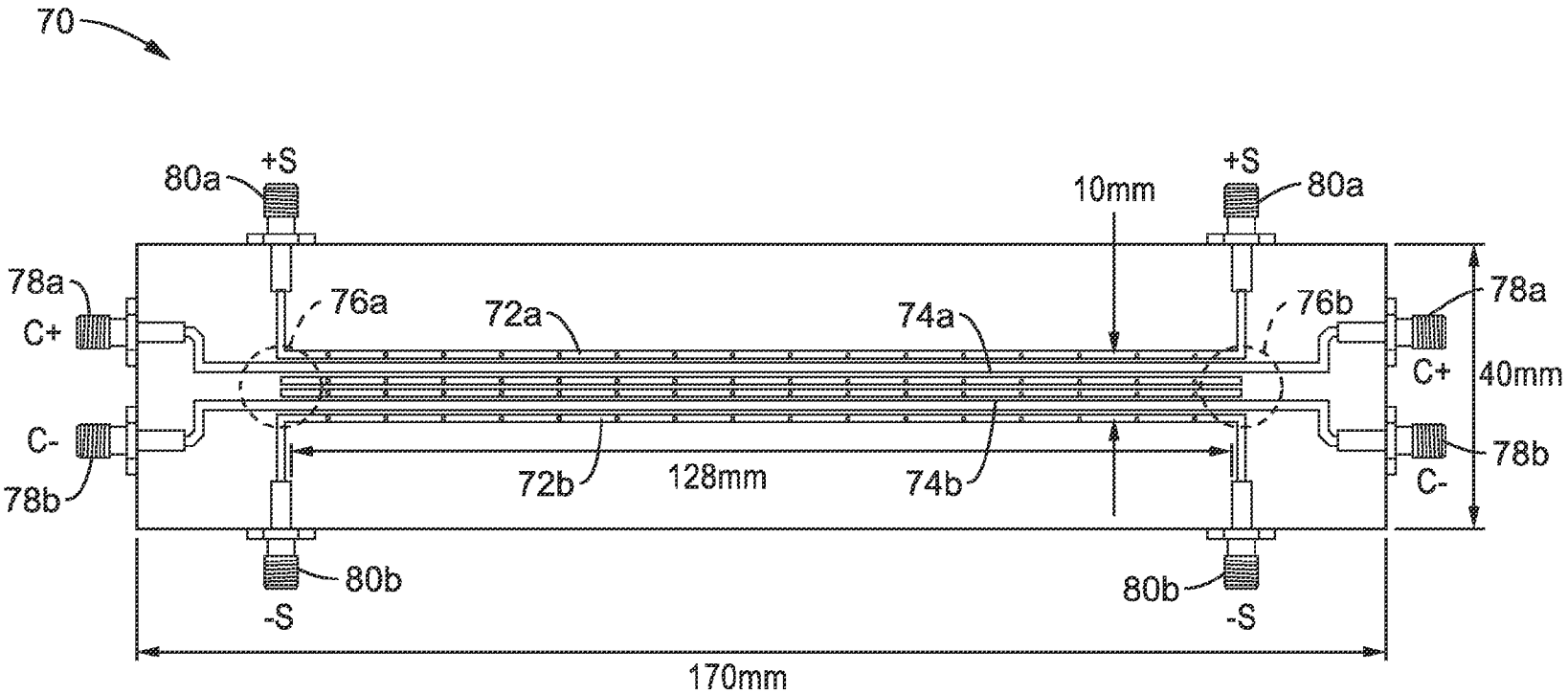
FIG. 5 is an image rendition of an implemented distributed modulated capacitor (DMC) circulator according to an embodiment of the disclosed technology.

FIG. 5 depicts (as a rendition of a photographic image) an example embodiment 70 of a DMC implementation through a double balanced configuration of varactor diodes, as was exemplified in the schematic of FIG. 1. In the figure, one can see the signal lines S+ 72*a*, S− 72*b*, and carrier line C+ 74*a*, C− 74*b*. This example comprises 16 unit cells, each of which contain the four varactor diodes, (as seen in FIG. 1). Structures 76*a* and 76*b* at each end of the lines are cross-overs of the transmission lines, the position of which is merely indicated with the dashed line circles to allow seeing the underlying traces. External connections are depicted on each end with carrier C+ 78*a*, C− 78*b*, and on the sides with signal +S 80*a*, −S 80*b*. The implemented device is seen with a board length of 170 mm, with a width of 40 mm. The actual TRL and carrier lines on that board are seen at 128 mm in length, with a width of 10 mm. It will be appreciated that the sizing shown above is by way of example for this configuration and frequency, and not by way of limitation. The example embodiment of FIG. 5 was fabricated on Roger Duroid substrate with dielectric constant of 3.55 and a thickness of 32 mils.

Figure 6:
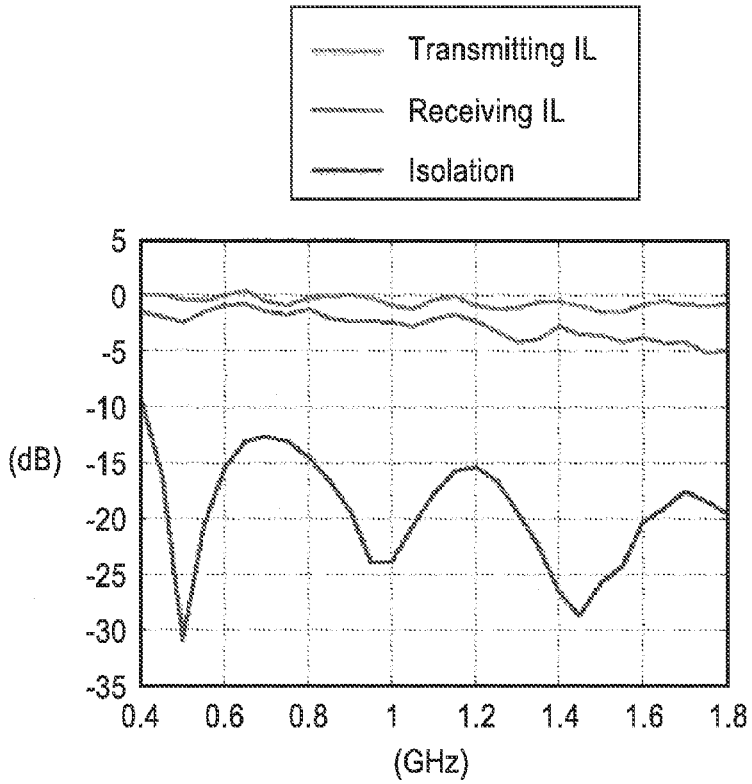
FIG. 6 is a plot of measured insertion loss and transmitter/receiver isolation for the DMC circulator of FIG. 5, utilized according to an embodiment of the disclosed technology.

FIG. 6 depicts measured performance of the DMC seen in FIG. 5, showing insertion loss (IL) for transmitting and receiving, as well as showing the isolation levels between the transmitter and receiver whose signals are utilizing the same path in different directions. In this example, the transmitter IL is from the transmitter to the antenna at the original frequency. The receiver IL is from the antenna to the receiver at the upconverted frequency. The insertion loss levels are seen as ranging between 0 and about 5 dB across the bandwidth. The isolation level is between the transmitter and receiver at the upconverted frequency, and is seen exceeding 10 dB across up to 30 dB across the bandwidth.

Figure 7:
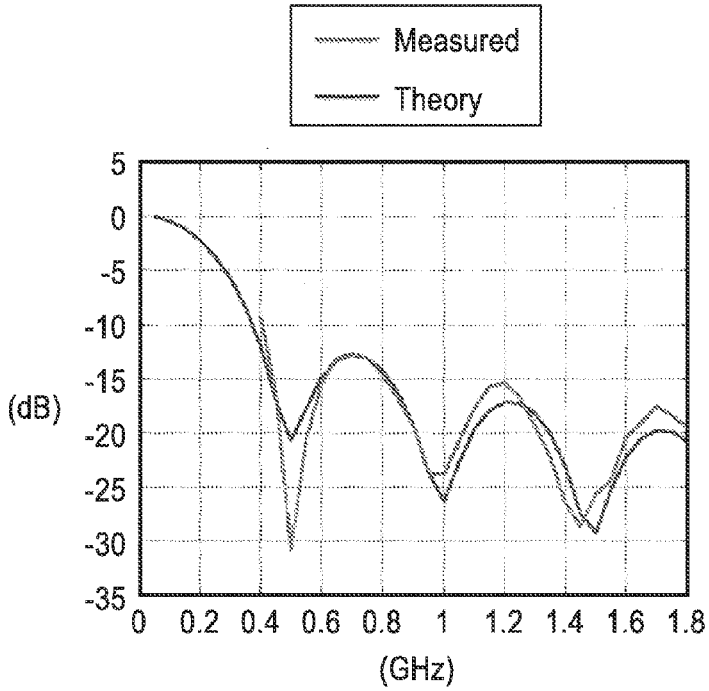
FIG. 7 is a plot comparing theoretical and measured levels of TX-RX isolation for the DMC circulator of FIG. 5, utilized according to an embodiment of the disclosed technology.

FIG. 7 depicts a comparison between measured TX-RX isolation and that given by the theory. It can be seen from the plot that the measured results are in close accord with the theoretical values.

Figure 8:
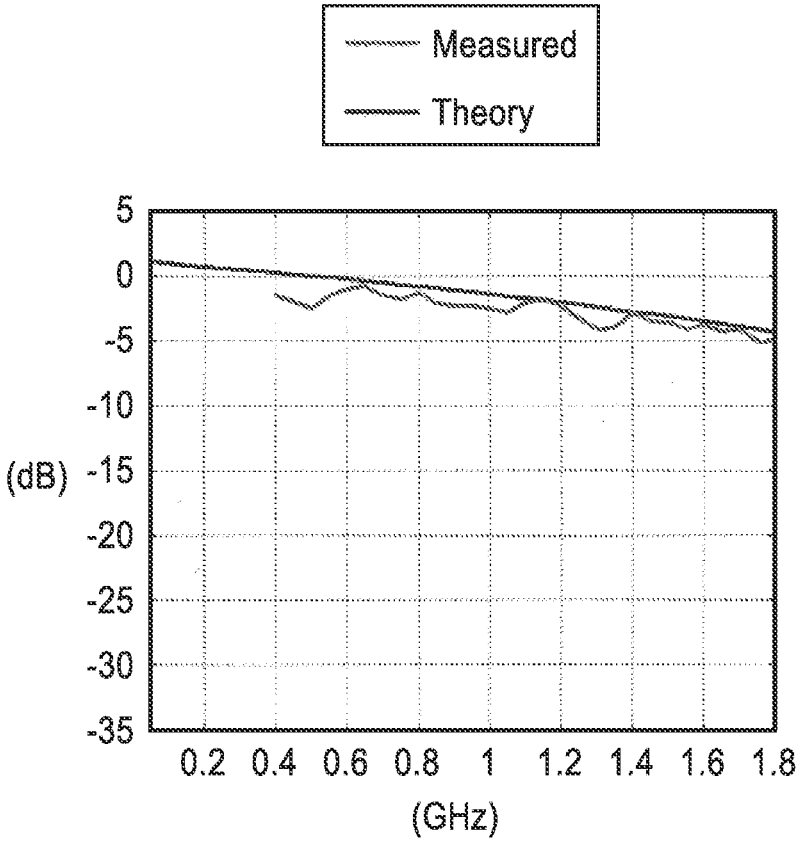
FIG. 8 is a plot comparing theoretical and measured levels of receiver insertion loss (IL) for the DMC circulator of FIG. 5, utilized according to an embodiment of the disclosed technology.

FIG. 8 depicts a comparison between measured receiving insertion loss (IL) and that given by the theory. It can be seen here as well, that the measured results are in accord with the theoretical values.

From the discussion above, it should be appreciated that DMC technology can potentially replace ferrite based circulators in future applications due to its compactness, broad bandwidth and compatibility to MMIC processing. The technology can potentially be implemented for RF front ends requiring simultaneous transmitting and receiving (STAR) at the same frequency band and the same time. In addition, the measured results with a hybrid circuit validated the theory while still offering significant performance benefits.

From the description herein, it will be appreciated that that the present disclosure encompasses multiple embodiments which include, but are not limited to, the following:

1. A distributedly modulated capacitor (DMC) apparatus, comprising: a first transmission line for propagating carrier waves; a second transmission line for propagating signal waves; and a plurality of time-varying capacitance elements coupled to said second transmission line for propagating signal waves, and to said first transmission line in which said carrier waves modulate capacitance of these time-varying capacitance elements; wherein said carrier waves and said signal waves propagate on separate first and second transmission lines which are electrically isolated from one another;

wherein shunt capacitance of both first and second transmission lines is predominantly controlled by said carrier waves; and wherein a signal traveling in an identical direction as that of said carrier wave is modulated on said carrier, while a signal travelling in an opposing direction is not modulated on said carrier.

2. The apparatus of any preceding embodiment, wherein said distributedly modulated capacitor (DMC) apparatus comprises an isolator or a circulator.

3. The apparatus of any preceding embodiment, wherein said time-varying capacitance elements comprise a double balanced configuration of varactor diodes.

4. The apparatus of any preceding embodiment, wherein a varactor diode is coupled between each half of a differential line forming said second transmission line, to each half of a differential line forming said first transmission line, so that four varactor diodes are required for each unit cell of said first and second transmission line.

5. The apparatus of any preceding embodiment, wherein said time-varying capacitance elements comprise variable capacitors.

6. The apparatus of any preceding embodiment, wherein a variable capacitor is coupled between said second transmission line to ground, and said first transmission line is coupled to control the capacitance of each said variable capacitor.

7. The apparatus of any preceding embodiment, wherein said first and second transmission lines are configured as a series connection of unit cells in which each unit cell has said time-varying capacitance elements coupled to the second transmission line as controlled by signals on said first transmission line.

8. The apparatus of any preceding embodiment, wherein said distributedly modulated capacitor (DMC) circulator apparatus is fabricated on single or multi-layer printed circuits without inclusion of magnetic components or material.

9. The apparatus of any preceding embodiment, wherein said distributedly modulated capacitor (DMC) circulator apparatus is configured for implementation by integrated circuit integration, without incorporation of any magnetic materials.

10. The apparatus of any preceding embodiment, wherein said distributedly modulated capacitor (DMC) circulator apparatus is configured for applications selected from a group of applications, consisting of compact radar systems, miniaturized radios, cellphones, and high performance radio-frequency identification (RFID) readers.

11. A distributedly modulated capacitor (DMC) apparatus, comprising: a double balanced configuration of varactor diodes operating as time-varying capacitances; a first differential transmission line for propagating carrier waves; and a second differential transmission line for propagating signal waves; wherein said carrier waves and said signal waves propagate on these different first and second differential transmission lines which are electrically isolated from one another; wherein shunt capacitance of both first and second differential transmission lines is predominantly controlled by the carrier waves; and wherein a signal traveling in the same direction as that of said carrier wave is modulated on the carrier while a signal travelling in an opposite direction is not modulated on the carrier.

12. The apparatus of any preceding embodiment, wherein said distributedly modulated capacitor (DMC) apparatus comprises an isolator or a circulator.

13. The apparatus of any preceding embodiment, wherein said double balanced configuration of varactor diodes comprises a varactor diode coupled between each half of said first differential transmission line, to each half of said second differential transmission line, so that four varactor diodes are required for each unit cell of said first and second differential transmission lines.

14. The apparatus of any preceding embodiment, wherein said first and second differential transmission lines are configured as a series connection of unit cells in which each unit cell has said varactor diode elements coupled to the second differential transmission line as controlled by signals on said first differential transmission line.

15. The apparatus of any preceding embodiment, wherein said distributedly modulated capacitor (DMC) circulator apparatus is fabricated on single or multi-layer printed circuits without inclusion of magnetic components or material.

16. The apparatus of any preceding embodiment, wherein said distributedly modulated capacitor (DMC) circulator apparatus is configured for implementation by integrated circuit integration, without incorporating magnetic materials.

17. The apparatus of any preceding embodiment, wherein said distributedly modulated capacitor (DMC) circulator apparatus is configured for applications selected from a group of applications, consisting of compact radar systems, miniaturized radios, cellphones, and high performance radio-frequency identification (RFID) readers.

18. A distributedly modulated capacitor (DMC) apparatus, comprising: a first transmission line for propagating carrier waves; a second transmission line for propagating signal waves; and a plurality of variable capacitors coupled from said second transmission line to ground, and having a capacitance control input coupled to said first transmission line, so that said carrier waves modulate capacitance of these variable capacitors; wherein said carrier waves and said signal waves propagate on separate first and second transmission lines which are electrically isolated from one another; wherein shunt capacitance of both first and second transmission lines is predominantly controlled by said carrier waves; and wherein a signal traveling in an identical direction as that of said carrier wave is modulated on said carrier while a signal travelling in an opposing direction is not modulated on said carrier.

19. The apparatus of any preceding embodiment, wherein said distributedly modulated capacitor (DMC) apparatus comprises an isolator or a circulator.

20. The apparatus of any preceding embodiment, wherein said first and second transmission lines are configured as a series connection of unit cells in which each unit cell has said variable capacitors coupled between said second transmission line and ground, while being controlled in response to a signal received from said first transmission line.

21. The apparatus of any preceding embodiment, wherein said distributedly modulated capacitor (DMC) circulator apparatus is fabricated on single or multi-layer printed circuits without inclusion of magnetic components or material.

22. The apparatus of any preceding embodiment, wherein said distributedly modulated capacitor (DMC) circulator apparatus is configured for implementation by integrated circuit integration, without inclusion of magnetic materials which are bulky and not readily implemented by integrated circuit process technology.

23. The apparatus of any preceding embodiment, wherein said distributedly modulated capacitor (DMC) circulator apparatus is configured for applications as selected from a group of applications, consisting of compact radar systems, miniaturized radios, cellphones, and high performance radio-frequency identification (RFID) readers.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

In the claims, reference to an element in the singular is not intended to mean "one and only one" unless explicitly so stated, but rather "one or more." All structural and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. A distributedly modulated capacitor (DMC) apparatus, comprising:

a first transmission line for propagating carrier waves;

a second transmission line for propagating signal waves; and a plurality of time-varying capacitance elements coupled to said second transmission line for propagating signal waves, and to said first transmission line in which said carrier waves modulate capacitance of these time-varying capacitance elements;

wherein said carrier waves and said signal waves propagate on separate first and second transmission lines which are electrically isolated from one another;

wherein shunt capacitance of both first and second transmission lines is predominantly controlled by said carrier waves; and wherein a signal traveling in an identical direction as that of said carrier wave is modulated on said carrier, while a signal travelling in an opposing direction is not modulated on said carrier.

2. The apparatus recited in claim 1, wherein said distributedly modulated capacitor (DMC) apparatus comprises an isolator or a circulator.

3. The apparatus recited in claim 1, wherein said first and second transmission lines are configured as a series connection of unit cells in which each unit cell has said time-varying capacitance elements coupled to the second transmission line as controlled by signals on said first transmission line.

4. The apparatus recited in claim 1, wherein said distributedly modulated capacitor (DMC) circulator apparatus is fabricated on single or multi-layer printed circuits without inclusion of magnetic components or material.

5. The apparatus recited in claim 1, wherein said distributedly modulated capacitor (DMC) circulator apparatus is configured for implementation by integrated circuit integration, without incorporation of any magnetic materials.

6. The apparatus recited in claim 1, wherein said distributedly modulated capacitor (DMC) circulator apparatus is configured for applications selected from a group of applications, consisting of compact radar systems, miniaturized radios, cellphones, and high performance radio-frequency identification (RFID) readers.

7. The apparatus recited in claim 1, wherein said time-varying capacitance elements comprise a double balanced configuration of varactor diodes.

8. The apparatus recited in claim 7, wherein a varactor diode is coupled between each half of a differential line forming said second transmission line, to each half of a differential line forming said first transmission line, so that four varactor diodes are required for each unit cell of said first and second transmission line.

9. The apparatus recited in claim 1, wherein said time-varying capacitance elements comprise variable capacitors.

10. The apparatus recited in claim 9, wherein a variable capacitor is coupled between said second transmission line to ground, and said first transmission line is coupled to control the capacitance of each said variable capacitor.

11. A distributedly modulated capacitor (DMC) apparatus, comprising:

a double balanced configuration of varactor diodes operating as time-varying capacitances;

a first differential transmission line for propagating carrier waves; and a second differential transmission line for propagating signal waves;

wherein said carrier waves and said signal waves propagate on these different first and second differential transmission lines which are electrically isolated from one another;

wherein shunt capacitance of both first and second differential transmission lines is predominantly controlled by the carrier waves; and wherein a signal traveling in the same direction as that of said carrier wave is modulated on the carrier while a signal travelling in an opposite direction is not modulated on the carrier.

12. The apparatus recited in claim 11, wherein said distributedly modulated capacitor (DMC) apparatus comprises an isolator or a circulator.

13. The apparatus recited in claim 11, wherein said double balanced configuration of varactor diodes comprises a varactor diode coupled between each half of said first differential transmission line, to each half of said second differential transmission line, so that four varactor diodes are required for each unit cell of said first and second differential transmission lines.

14. The apparatus recited in claim 11, wherein said first and second differential transmission lines are configured as a series connection of unit cells in which each unit cell has said varactor diode elements coupled to the second differential transmission line as controlled by signals on said first differential transmission line.

15. The apparatus recited in claim 11, wherein said distributedly modulated capacitor (DMC) circulator apparatus is fabricated on single or multi-layer printed circuits without inclusion of magnetic components or material.

16. The apparatus recited in claim 11, wherein said distributedly modulated capacitor (DMC) circulator apparatus is configured for implementation by integrated circuit integration, without incorporating magnetic materials.

17. The apparatus recited in claim 11, wherein said distributedly modulated capacitor (DMC) circulator apparatus is configured for applications selected from a group of applications, consisting of compact radar systems, miniaturized radios, cellphones, and high performance radio-frequency identification (RFID) readers.

18. A distributedly modulated capacitor (DMC) apparatus, comprising:

a first transmission line for propagating carrier waves;

a second transmission line for propagating signal waves; and a plurality of variable capacitors coupled from said second transmission line to ground, and having a capacitance control input coupled to said first transmission line, so that said carrier waves modulate capacitance of these variable capacitors;

wherein said carrier waves and said signal waves propagate on separate first and second transmission lines which are electrically isolated from one another;

wherein shunt capacitance of both first and second transmission lines is predominantly controlled by said carrier waves; and wherein a signal traveling in an identical direction as that of said carrier wave is modulated on said carrier while a signal travelling in an opposing direction is not modulated on said carrier.

19. The apparatus recited in claim 18, wherein said distributedly modulated capacitor (DMC) apparatus comprises an isolator or a circulator.

20. The apparatus recited in claim 18, wherein said first and second transmission lines are configured as a series connection of unit cells in which each unit cell has said variable capacitors coupled between said second transmission line and ground, while being controlled in response to a signal received from said first transmission line.

21. The apparatus recited in claim 18, wherein said distributedly modulated capacitor (DMC) circulator apparatus is fabricated on single or multi-layer printed circuits without inclusion of magnetic components or material.

22. The apparatus recited in claim 18, wherein said distributedly modulated capacitor (DMC) circulator apparatus is configured for implementation by integrated circuit integration, without inclusion of magnetic materials which are bulky and not readily implemented by integrated circuit process technology.

23. The apparatus recited in claim 18, wherein said distributedly modulated capacitor (DMC) circulator apparatus is configured for applications as selected from a group of applications, consisting of compact radar systems, miniaturized radios, cellphones, and high performance radio-frequency identification (RFID) readers.

* * * * *